US008105046B2

(12) United States Patent
Kitsunai et al.

(10) Patent No.: US 8,105,046 B2
(45) **Date of Patent: *Jan. 31, 2012**

(54) PROPELLER FOR WATERCRAFT AND OUTBOARD MOTOR

(75) Inventors: Toru Kitsunai, Shizuoka (JP); Morimitsu Manabe, Shizuoka (JP); Yukihiro Kurimoto, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1106 days.

This patent is subject to a terminal disclaimer.

(21) Appl. No.: 11/840,254

(22) Filed: Aug. 17, 2007

(65) Prior Publication Data

US 2008/0050990 A1 Feb. 28, 2008

(30) Foreign Application Priority Data

Aug. 25, 2006 (JP) ..... 2006-229906

(51) Int. Cl.
*B63H 1/26* (2006.01)

(52) U.S. Cl. ..... 416/244 B

(58) Field of Classification Search ..... 416/244 B
See application file for complete search history.

(56) References Cited

U.S. PATENT DOCUMENTS

| | | | | |
|---|---|---|---|---|
| 4,847,048 | A * | 7/1989 | Nishi et al. | 420/547 |
| 5,158,433 | A | 10/1992 | Cleary | |
| 6,893,305 | B2 | 5/2005 | Natsume et al. | |
| 2005/0026516 | A1 | 2/2005 | Natsume et al. | |
| 2005/0109429 | A1 | 5/2005 | Okamoto et al. | |

FOREIGN PATENT DOCUMENTS

| | | | |
|---|---|---|---|
| JP | 48095946 | A * | 12/1973 |
| JP | 60-033192 | A | 2/1985 |
| JP | 61-253395 | A | 11/1986 |
| JP | 62-289498 | A | 12/1987 |
| JP | 04-289194 | A | 10/1992 |
| JP | 3029215 | U | 9/1996 |
| JP | 09-001319 | A | 1/1997 |
| JP | 2004-232087 | A | 8/2004 |
| JP | 2005-048820 | A | 2/2005 |

OTHER PUBLICATIONS

Toru Kitsunai et al.; "Propeller for Watercraft and Outboard Motor"; U.S. Appl. No. 11/840,253, filed Aug. 17, 2007.

* cited by examiner

*Primary Examiner* — Edward Look
*Assistant Examiner* — Dwayne J White
(74) *Attorney, Agent, or Firm* — Keating & Bennett, LLP

(57) ABSTRACT

A propeller for watercraft having excellent abrasion resistance includes a propeller body having a blade and a hub portion, the propeller body being molded by casting an aluminum alloy, and an anodic oxide coating provided so as to cover a surface of the propeller body, the anodic oxide coating being obtained by performing a blast treatment for the surface of the propeller body and thereafter subjecting the surface to anodic oxidation.

12 Claims, 7 Drawing Sheets

PROPELLER FOR WATERCRAFT AND OUTBOARD MOTOR

BACKGROUND OF THE INVENTION

1. Field of the Invention

The present invention relates to a propeller for watercraft and an outboard motor.

2. Description of the Related Art

An outboard motor can be attached to a boat body by being simply engaged onto the stern of a boat, and does not occupy any space inside the boat. Therefore, outboard motors are widely used for small-sized boats, e.g., pleasure boats and small fishing boats. In accordance with the boat body sizes and purposes, outboard motors of various output powers are in use today.

Generally speaking, an outboard motor having a propeller made of stainless steel and an engine with high output power (e.g., 100 horsepower or more) is used for a relatively large boat. On the other hand, for a relatively small boat, an outboard motor having a propeller made of aluminum or the like and an engine with relatively low output power is used. An aluminum propeller is light-weight and can be produced at low cost, and therefore is suitable as a propeller of an outboard motor having an engine with a small output power.

In the case of forming a propeller for watercraft from an aluminum alloy, it is necessary to prevent corrosion of the aluminum alloy caused by seawater. Therefore, generally speaking, propellers having an aluminum alloy propeller body painted or coated with a corrosion resistant or preventive material are widely used.

Japanese Utility Model No. 3029215 discloses, in order to prevent deteriorations in water dissipation during the rotation of a propeller (which may happen when the propeller edge is made dull by any painted film that is provided on the propeller surface), subjecting an aluminum-alloy propeller to a hard anodized aluminum treatment is necessary to secure a sharp propeller edge.

Small-sized boats having an outboard motor are often used at inshore locations and on rivers, for purposes such as fishery, business operations, and leisure activities. Such boats may be pulled onto a sand beach for mooring, or may be moored in the sandy shallow area by a river shore. Therefore, when mooring a boat, or when going out onto the river or the sea from a point of mooring, sand may be stirred up, and the propeller surface is likely to be abraded as the propeller is rotated in the sand-containing water. As a result, the painting on the propeller surface may peel due to abrasion, the propeller body may be corroded, and the propeller body may be abraded. Since a paint coating does not have sufficient hardness, the propeller of a conventional outboard motor has a problem of short life ascribable to abrasion.

Japanese Utility Model No. 3029215 merely discloses forming an anodized aluminum layer (which is known as a corrosion-protective coating for aluminum), instead of a painted film for corrosion protection, without disclosing the aforementioned problems. Moreover, in order not to allow the propeller edge to become dull, it would be impossible to form a thick layer of hard anodized aluminum. Therefore, the thickness of the hard anodized aluminum layer for a propeller according to Japanese Utility Model No. 3029215 can only be about 15 μm, which is not considered to provide sufficient abrasion resistance.

Moreover, generally speaking, an aluminum-alloy propeller is molded by die casting or gravity casting. However, even a propeller after being molded is subjected to an anodic oxidation treatment as it is, variations may occur in the coating thickness. This makes it difficult to obtain sufficient abrasion resistance. Moreover, providing a thick coating in order to obtain sufficient abrasion resistance makes it necessary to perform anodic oxidation over a long time, which lowers the hardness of the film and hence invites a lower abrasion resistance.

Such problems occur not only in boats having outboard motors, but also in small-sized boats whose engines are mounted within the boats.

SUMMARY OF THE INVENTION

In order to overcome the problems described above, preferred embodiments of the present invention provide a propeller for watercraft and an outboard motor having excellent abrasion resistance.

A propeller for watercraft according to a preferred embodiment of the present invention includes: a propeller body having a blade and a hub portion, the propeller body being molded by casting an aluminum alloy; and an anodic oxide coating arranged so as to cover a surface of the propeller body, the anodic oxide coating being obtained by performing a blast treatment for the surface of the propeller body and thereafter subjecting the surface to anodic oxidation.

In a preferred embodiment, the aluminum alloy contains silicon, and at an interface of the propeller body between itself and the anodic oxide coating, eutectic regions containing eutectic silicon particles each have a length of about 18 μm or less.

In a preferred embodiment, the anodic oxide coating has a surface roughness Rz of no less than about 25 μm and no more than about 40 μm.

In a preferred embodiment, the anodic oxide coating has a thickness of no less than about 20 μm and no more than about 100 μm.

In a preferred embodiment, the anodic oxide coating has a hardness of no less than about 350 Hv and no more than about 450 Hv.

In a preferred embodiment, the propeller body is molded by a die casting technique using the aluminum alloy.

In a preferred embodiment, the eutectic silicon particles in the eutectic regions each have a particle size of about 0.8 μm or less at the interface.

In a preferred embodiment, the aluminum alloy is an Al—Mg alloy containing no less than about 0.3 wt % and no more than about 2.0 wt % of silicon.

An outboard motor according to a preferred embodiment of the present invention includes any of the aforementioned propellers for watercraft.

A boat according to a preferred embodiment of the present invention includes any of the aforementioned propellers for watercraft.

A propeller for watercraft according to another preferred embodiment of the present invention includes: a propeller body obtained by die-casting an aluminum alloy which contains silicon at a rate of no less than about 0.3 wt % and no more than about 2.0 wt %; and an anodic oxide coating provided on a surface of the propeller body, wherein, the anodic oxide coating has a thickness of no less than about 20 μm and no more than about 100 μm, with a difference of about 25 μm or less between a maximum thickness and a minimum thickness of the anodic oxide coating.

In a preferred embodiment, the anodic oxide coating has a hardness of no less than about 350 Hv and no more than about 450 Hv.

A method of producing a propeller for watercraft according to another preferred embodiment of the present invention includes: step (A) of molding a propeller body by casting an aluminum alloy, the propeller body having a blade and a hub portion; step (B) of performing a blast treatment for a surface of the propeller body; and step (C) of subjecting the propeller body having experienced the blast treatment to anodic oxidation to form an anodic oxide coating covering the surface of the propeller body.

In a preferred embodiment, the aluminum alloy contains silicon, and the blast treatment of step (B) is performed so that, at an interface of the propeller body between itself and the anodic oxide coating, eutectic regions containing eutectic silicon particles each have a length of about 18 μm or less.

In a preferred embodiment, the blast treatment of step (B) is performed so that the anodic oxide coating has a surface roughness Rz of no less than about 25 μm and no more than about 40 μm.

In a preferred embodiment, at step (C), a length of time for which the anodic oxidation is performed is adjusted so that the anodic oxide coating has a thickness of no less than about 20 μm and no more than about 100 μm.

In a preferred embodiment, at step (C), a concentration and a temperature of an electrolytic bath used for the anodic oxidation are adjusted so that the anodic oxide coating has a hardness of no less than about 350 Hv and no more than about 450 Hv.

In a preferred embodiment, step (A) includes molding the propeller body by a die casting technique.

In a preferred embodiment, the molding of step (A) is performed so that the eutectic silicon particles in the eutectic regions each have a particle size of about 0.8 μm or less at the interface.

In a preferred embodiment, the aluminum alloy is an Al—Mg alloy containing no less than about 0.3 wt % and no more than about 2.0 wt % of silicon.

According to various preferred embodiments of the present invention, a surface of the propeller body is covered with an anodic oxide coating having a high hardness, thus providing excellent abrasion resistance. Moreover, the anodic oxide coating is obtained by performing a blast treatment for the surface of the propeller body that has been molded by casting, and thereafter subjecting the surface to anodic oxidation. Thus, the blast treatment provides an improvement on the non-uniformnesses in composition near the surface of the propeller body (e.g., eutectic structures and the like that have deposited through the casting), whereby an anodic oxide coating having a uniform film thickness is obtained. Therefore, problems such as corrosion due to progress of partial abrasion are unlikely to occur, and thus the propeller can enjoy a long product life. As a result, a durable and economical propeller for watercraft is realized.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of a propeller for watercraft and an outboard motor according to the present invention will be described.

Figure 1A:
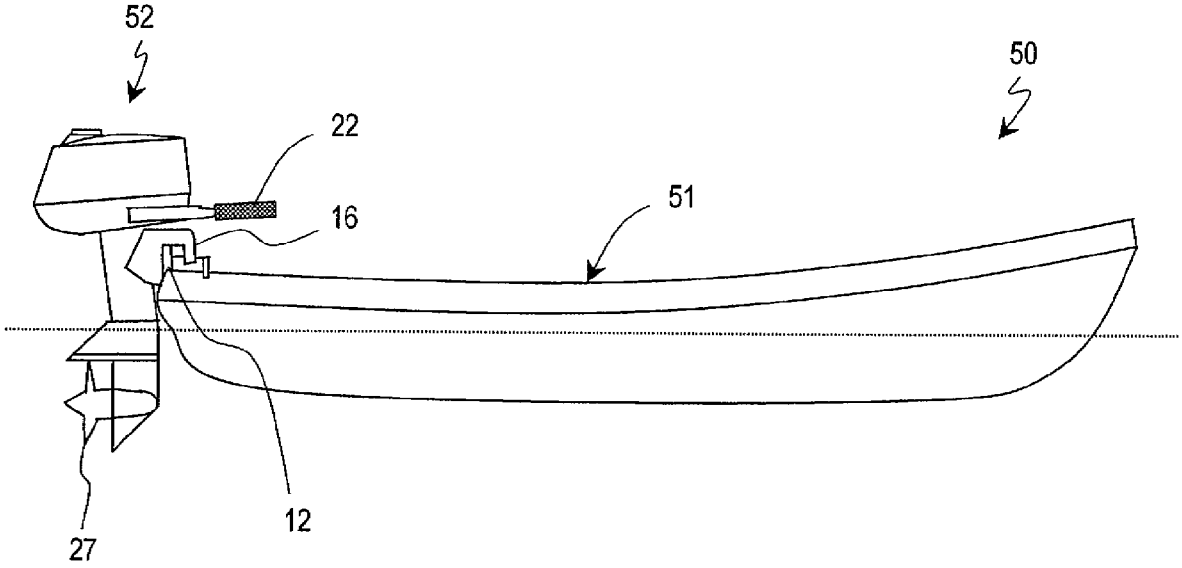
FIG. 1A is a side view of a boat having an outboard motor according to a preferred embodiment of the present invention.
Figure 2:
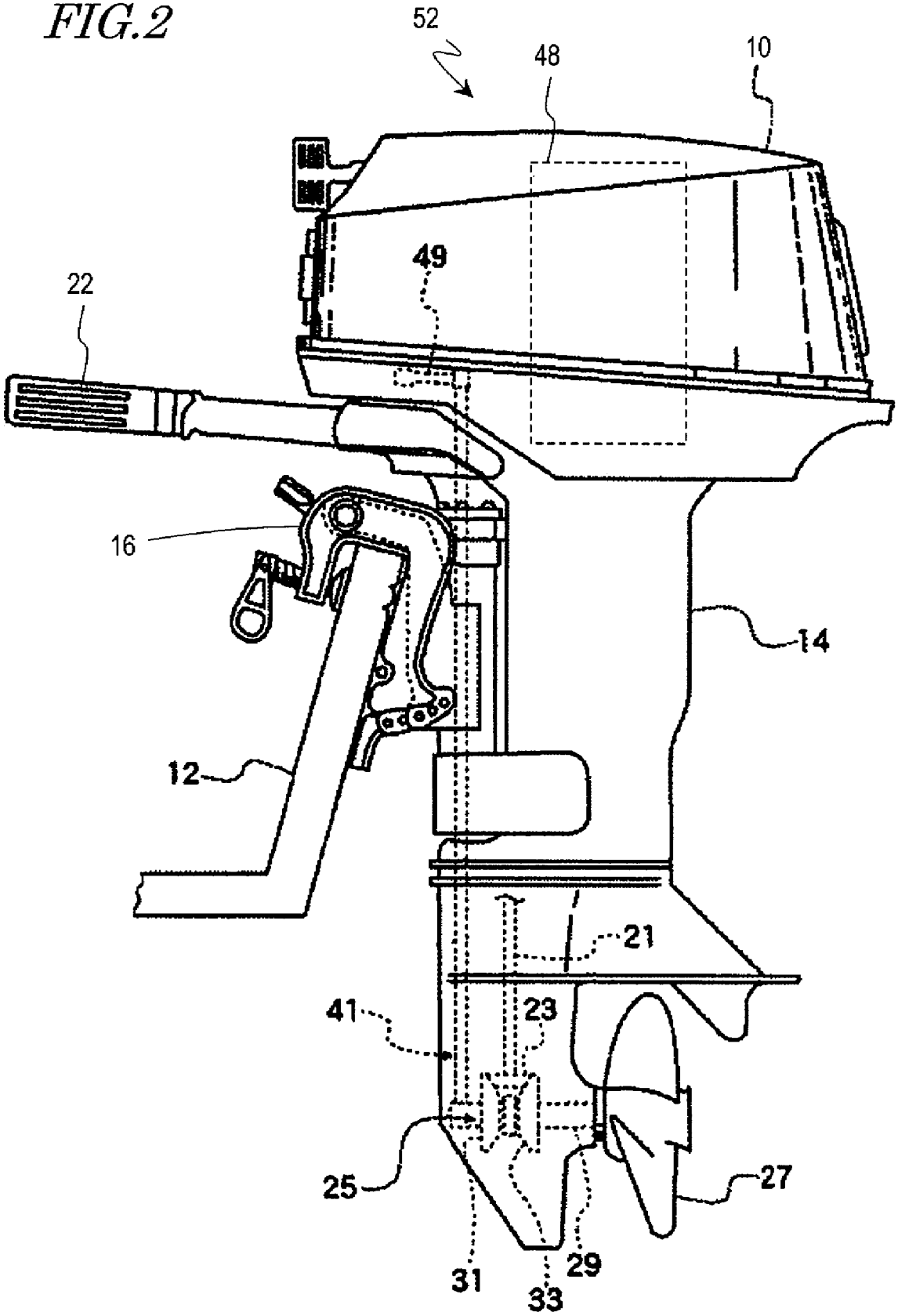
FIG. 2 is a side view showing a preferred embodiment of an outboard motor according to the present invention.

FIG. 1A is a side view of a boat 50 having an outboard motor according to a preferred embodiment of the present invention. The boat 50 includes a boat body 51 and an outboard motor 52. The outboard motor 52 includes a clamp 16, a propeller 27, and a steering handle 22. The outboard motor 52 is attached at a stern 12 of the boat body 51 with a clamp 16. With the steering handle 22, the driver is able to change the direction of travel of the boat 50. FIG. 2 is a side view of the outboard motor 52. The outboard motor 52 includes an engine 48, such that rotary motive force from the engine 48 is transmitted to a drive shaft 21, to which a driving gear 23 is attached. In order to cause the boat 50 to move forward or backward by changing the direction of rotation of the propeller 27, the outboard motor 52 includes a switching mechanism 41 and a clutch device 25. The clutch device 25 includes a forward gear 31 and a reverse gear 33. By operating a shift lever 49 which is linked to the switching mechanism 41, either the forward gear 31 or the reverse gear 33 is allowed to selectively engage with the driving gear 23. As a result, the propeller 27 which is fixed to the output shaft 29 rotates in the forward direction or reverse direction. The engine 48 and the aforementioned driving mechanism are accommodated inside a casing 14 and a cowling 10.

Figure 1B:
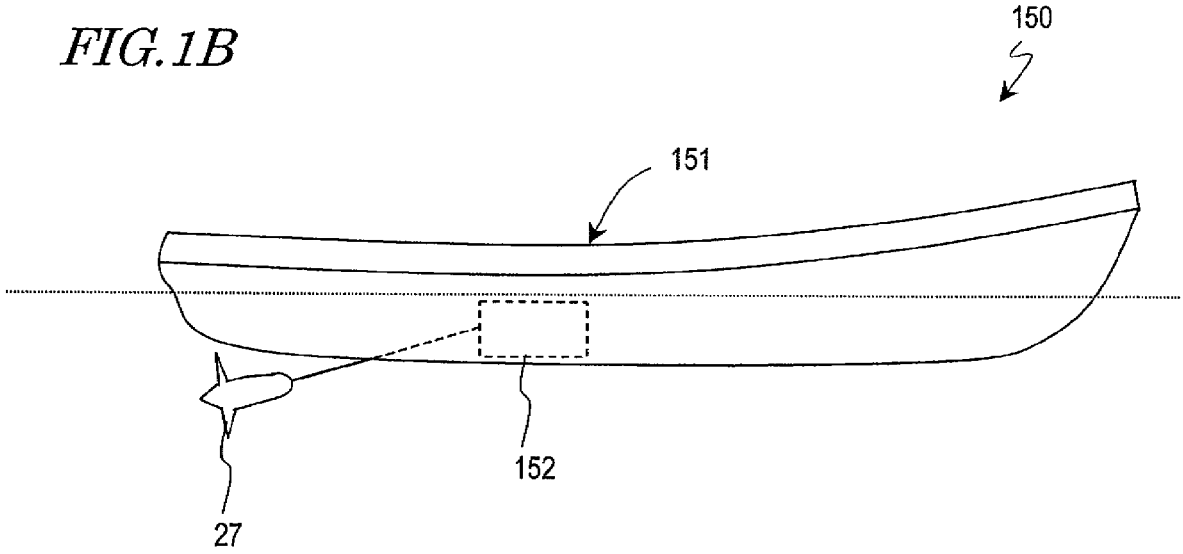
FIG. 1B is a side view showing a boat having a propeller for watercraft according to a preferred embodiment of the present invention.

The propeller for watercraft according to a preferred embodiment of the present invention is suitably used for an outboard motor, but is also suitable for a boat having a so-called "inboard" engine which is mounted within the boat body. FIG. 1B is a side view of a boat 150 having a propeller 27 for watercraft according to a preferred embodiment of the present invention. Within the boat body 151 of the boat 150, an engine 152 is mounted, such that motive force from the engine 152 is transmitted via a shaft to the propeller 27 which is supported at the rear of the bottom so as to be capable of rotating.

Figure 3:
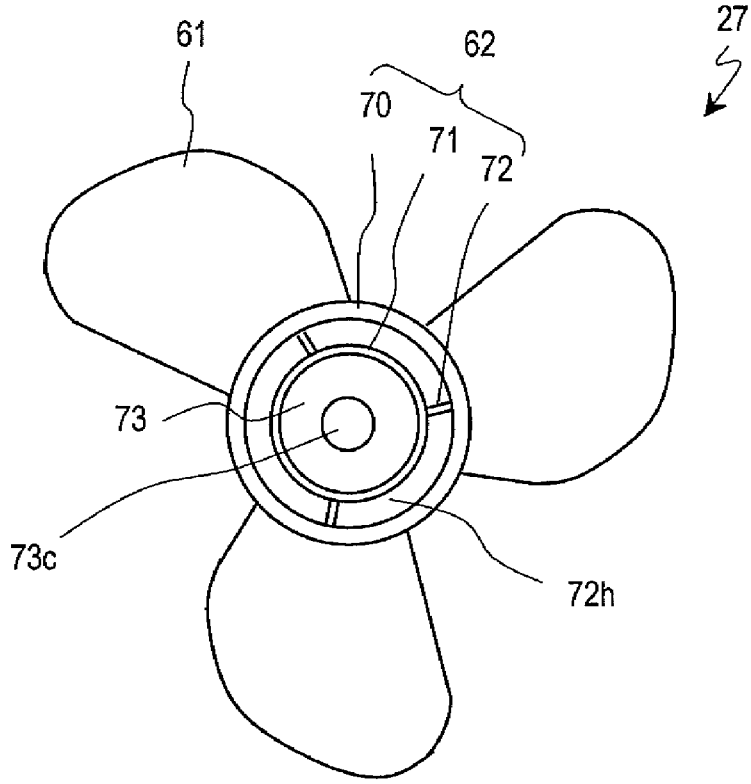
FIG. 3 is a plan view showing a preferred embodiment of a propeller of an outboard motor according to the present invention.

FIG. 3 is a plan view showing the propeller 27. The propeller 27 includes blades 61 and a hub portion 62 to which the blades 61 are connected. In the present preferred embodiment, the hub portion 62 includes an outer hub 70, an inner hub 71, and ribs 72 connecting the outer hub 70 to the inner hub 71. The present preferred embodiment adopts a structure in which the outboard motor 52 allows exhaust gas from the engine 48 to be ejected toward the rear of the propeller 27, through a gap 72*h* between the inner hub 71 and the outer hub 70, hence arriving at the double-structured hub portion. The hub portion 62 may have a single structure in the case where the outboard motor 52 allows exhaust gas to be released at another location. There is no limitation as to the number of blades 61 and their shape. The propeller 27 may have any other shape than that illustrated in FIG. 3.

The inner hub 71 of the hub portion 62 defines a substantially cylindrical internal space, with a bushing 73 being press-fitted into the internal space. The bushing 73 is composed of an elastic body such as rubber, such that the bushing 73 is fixed within the inner hub 71 based on friction between the bushing 73 and the inner hub 71. A hole 73*c* is provided in the center of the bushing 73, and the output shaft 29 is inserted into the hole 73*c*.

Since the bushing 73 and the inner hub 71 are fixed based on friction, when the propeller 27 collides into driftwood or the like during its rotation, the bushing 73 will slip inside the inner hub 71, so that the propeller 27 can come to a stop while allowing the output shaft 29 to rotate. Thus, destruction of various gears and malfunctioning of the engine 48 are prevented.

According to a preferred embodiment of the present invention, the surface of the propeller 27 is covered with an anodic oxide coating. In order to enhance the abrasion resistance characteristics of an aluminum-alloy propeller for watercraft, the inventors have studied forming an anodic oxide coating on the propeller surface. The reason is that an anodic oxide coating of aluminum generally has a high hardness, and therefore is believed to be suitable for enhancing abrasion resistance characteristics. However, through detailed studies it has been found that the additional elements (other than aluminum) included in an aluminum alloy composing a propeller make it difficult to obtain an anodic oxide coating having a uniform thickness.

Figure 4:
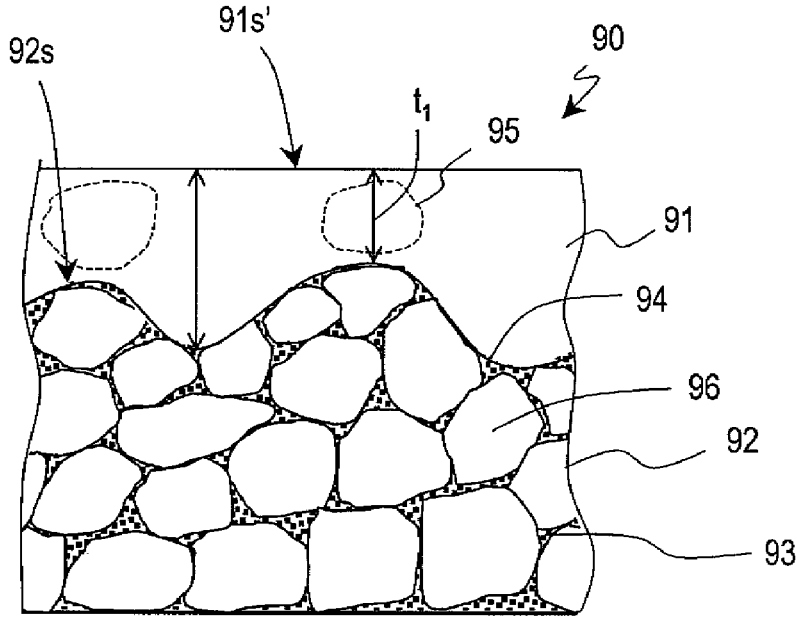
FIG. 4 is a schematic diagram showing a structure which is obtained when subjecting a propeller body to anodic oxidation without performing a blast treatment.

FIG. 4 schematically shows a cross-sectional structure of a propeller 90, which is composed of a propeller body that has been molded by a die casting technique, with an anodic oxide coating formed on its surface by anodic oxidation. As shown in FIG. 4, an anodic oxide coating 91 is formed on the surface of a propeller body 92 composed of an aluminum alloy.

In order to reduce the production cost and enhance the bonding strength between the blade and the hub portion, the propeller body 92 is integrally-molded by casting. Moreover, during casting, it is common practice to add silicon to the aluminum alloy so as to enhance the flowability of the melt of the aluminum alloy, thereby allowing the melt to permeate the mold. However, when the melt is cooled, primary crystals of aluminum will emerge, and after alloy phases 96 are formed, eutectic structures containing eutectic silicon particles 94 will deposit. Each such congregation of eutectic structures will be referred to as a eutectic region 93. It has been found that the eutectic regions 93 are less susceptible to anodic oxidation than the alloy phases 96, and that, the eutectic regions 93 does not exist uniformly at the vicinity of the surface 91*s*'. This has led to the finding that there is a large difference between a thickness $t_1$ of an anodic oxide coating in any portion where a eutectic region 93 is large or exists at a large proportion and a thickness $t_2$ of any portion where a eutectic region 93 is small or exists at a small proportion. This causes large variations in thickness over the entire anodic oxide coating 91.

Moreover, a natural oxide film may occur on the surface of the propeller body 92 having been molded by casting. The natural oxide film hinders generation of the anodic oxide coating, and therefore may cause variations in the film thickness of the anodic oxide coating.

In order to reduce such variations in thickness, the inventors have found it effective to perform, before performing anodic oxidation, a blast treatment for the surface of the propeller body 92 so as to crush the eutectic regions 93 which have deposited near the surface of the propeller body 92 and to make the distribution of the eutectic regions 93 even, thus reducing the size of the eutectic regions 93. As used herein, a blast treatment refers to any treatment which shoots a shot material against a target object (e.g., shotblasting) in order to mechanically grind the surface of the target object or allow the kinetic energy of the shot material to act on the surface of the target object.

When a blast treatment is performed on the surface of the propeller body, the surface roughness of the propeller body will increase. Since the surface of an anodic oxide coating to be formed reflects the surface roughness of the propeller body before performing the anodic oxidation, the propeller having the anodic oxide coating formed thereon will also have a rough surface. As is disclosed in Japanese Laid-Open Patent Publication No. 60-33192, it has conventionally been considered that the surface roughness of a propeller greatly affects the propulsion power of the propeller, such that the propulsion power is greatly lowered as the surface of the propeller becomes rougher. Therefore, as is disclosed in Japanese Laid-Open Patent Publication No. 09-001319, for example, even if there is knowledge of performing an etching or shotblasting treatment for the surface of an aluminum alloy for forming a decorative anodic oxide coating that provides an esthetic appearance, it has conventionally been believed that performing a blast treatment for a propeller body with the purpose of forming an anodic oxide coating would lower the propulsion power and thus be inappropriate. However, the inventors have found through their studies that, so long as the surface roughness remains equal to or less than a predetermined value, hardly any decrease in propulsion power will occur even if the surface of a propeller becomes rough through a blast treatment. Hereinafter, the structure of the propeller 27 will be described in more detail.

Figure 5:
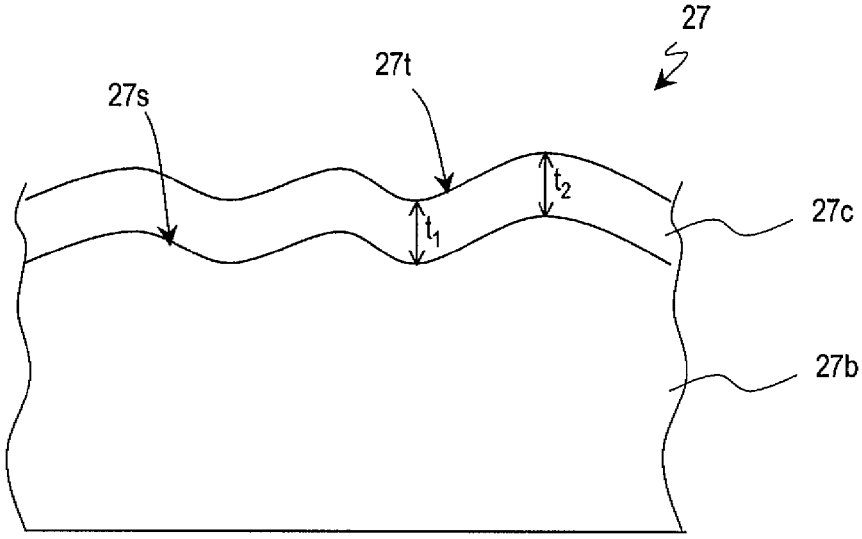
FIG. 5 is a view showing a partial cross section of a blade of the propeller of FIG. 3.

FIG. 5 shows a cross section near one surface of a blade 61 of the propeller 27. The propeller 27 includes, in its blades 61 and hub portion 62 (see FIG. 3), a propeller body 27*b* and an anodic oxide coating 27*c* provided on the surface of the propeller body 27*b*. Although not shown, in the blades 61 and hub portion 62, an anodic oxide coating 27*c* is also provided on the other surface of the propeller body 27*b*.

As mentioned above, using an aluminum alloy, the propeller body 27*b* is integrally-molded by casting. Therefore, the propeller body is composed of an aluminum alloy of a composition which is suitable for casting. The aluminum alloy preferably contains silicon so that, when the aluminum alloy is melted, the melt has sufficient flowability. More preferably, the aluminum alloy contains no less than about 0.3 wt % and no more than about 2.0 wt % of silicon. If the silicon content is smaller than about 0.3 wt %, the melt will not have sufficient flowability, thus resulting in poor castability. On the other hand, if the silicon content is greater than about 2.0 wt %, the eutectic silicon particles will become large (as described below), thus making it difficult to obtain a uniform anodic oxide coating even after being subjected to a predetermined blast treatment.

Molding of the propeller body 27*b* is preferably performed by a die casting technique. Use of a die casting technique allows the melt to be rapidly cooled after the melt is injected into a mold, whereby the eutectic regions can be made small. The particle size of the eutectic silicon particles can also be made small.

More preferably, the aluminum alloy further contains no less than about 0.5 wt % and no more than about 1.8 wt % of at least one of iron and manganese. When at least one of iron and manganese is contained at the aforementioned rate, it is possible to obtain an improved releasability from the mold in die casting molding, thus preventing burning onto the mold. Moreover, when magnesium is contained at a rate of no less than about 2.5 wt % and no more than about 5.5 wt %, mechanical properties such as mechanical strength, elongation, and shock resistance can be improved, and anticorrosiveness can also be improved.

For example, an Al—Mg alloy having a composition such as Al-4Mg-0.8Fe-0.4Mn, Al-5Mg-1.3Si-0.8Fe-0.8Mn, Al-4.5Mg-1.1Fe-0.7Mn, or Al-6.5Mg-1.1Fe-0.7Mn can be used as the aluminum alloy.

The anodic oxide coating 27*c* is obtained by, after performing a blast treatment for the surface of the propeller body 27*b*, subjecting the surface to an anodic oxidation. Referring to FIG. 5, the surface 27*t* of the anodic oxide coating 27*c* preferably has a roughness Rz of about 40 μm or less. Since the anodic oxide coating 27*c* is obtained by subjecting the surface of the propeller body 27*b* to anodic oxidation, the surface 27*t* conforms to the surface of the propeller body 27*b* before performing the anodic oxidation. Thus, the roughness of the surface 27*t* generally matches the roughness of the surface after the propeller body 27*b* has been subjected to a blast treatment.

Generally speaking, an anodic oxide coating 27*c* of an aluminum alloy has a high hardness. Therefore, the propeller 27 having the anodic oxide coating 27*c* formed thereon acquires a high abrasion resistance. More preferably, the anodic oxide coating has a hardness of no less than about 350 Hv and no more than about 450 Hv. If the hardness of the anodic oxide coating is smaller than about 350 Hv, sufficient abrasion resistance characteristics cannot be obtained. On the other hand, the hardness of the anodic oxide coating should preferably be as high as possible. However, in order to obtain an anodic oxide coating having a hardness greater than about 450 Hv, it will become necessary to employ special treatment liquids, which will increase the production cost of the anodic oxide coating.

The anodic oxide coating 27*c* preferably has a thickness of no less than about 20 μm and no more than about 100 μm. As used herein, "thickness" refers to a thickness as ascertained by "coating thickness measurement by microscope" defined under JIS H8680. If the minimum film thickness of the anodic oxide coating is smaller than about 20 μm, adequate abrasion resistance characteristics will not be obtained. On the other hand, as the anodic oxide coating becomes thicker, the abrasion resistance will improve. However, if the maximum film thickness of the anodic oxide coating 27*c* exceeds about 100 μm, a long time will be required for forming the anodic oxide coating, thus resulting in a poorer producibility.

The hardness of the anodic oxide coating 27*c* can be adjusted by changing the concentration and temperature of an electrolytic bath which is used for the anodic oxidation. The thickness of the anodic oxide coating 27*c* can be adjusted based on the length of time of anodic oxidation. As a method of anodic oxidation treatment for forming the anodic oxide coating 27*c*, it is preferable to use a treatment method which allows a hard anodic oxide coating to be formed, and an electrolyte such as sulfuric acid or oxalic acid can be used.

Figure 6:
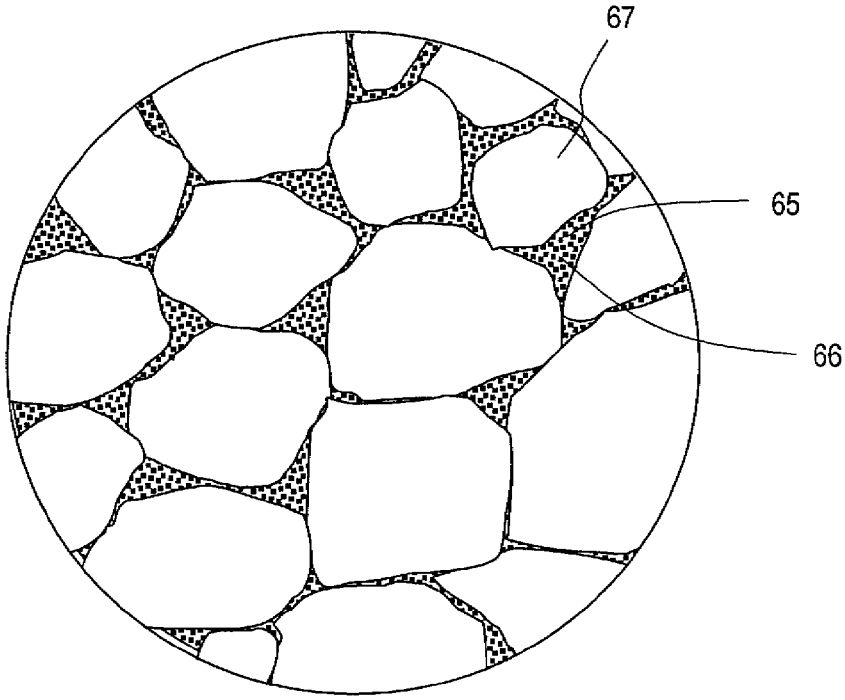
FIG. 6 is a diagram schematically showing a structural texture at an interface of a propeller body between itself and an anodic oxide coating in FIG. 5.

FIG. 6 schematically shows a crystal structure at an interface 27*s* of the propeller body 27*b* between itself and the anodic oxide coating 27*c*. As shown in FIG. 6, at the interface 27*s* of the propeller body 27*b*, eutectic regions 66 containing eutectic silicon particles 65 have deposited among alloy phases 67. Each eutectic region 66 preferably has a length of about 18 μm or less. As used herein, the "length" of a eutectic region 66 refers to the greatest among any lengthwise measurements of the eutectic region obtained by "coating thickness measurement by microscope" at the interface. If the lengths of the eutectic regions 66 are greater than about 18 μm, the anodic oxide coating will have a non-uniform film thickness even after being subjected to a blast treatment, and thus sufficient abrasion resistance characteristics will not be obtained in portions of small film thicknesses. As a result, the propeller body may be exposed and experience corrosion and the like.

Preferably, the eutectic silicon particles 65 in the eutectic regions 66 each have a particle size of about 0.8 μm or less. If the particle size of the eutectic silicon particles 65 is greater than about 0.8 μm, the anodic oxide coating will have a non-uniform film thickness. As used herein, the "particle size" of a eutectic silicon particle refers to a value obtained by measuring a longer side and a shorter side of a eutectic silicon particle with an electron microscope, and then subjecting the measurement values to the calculation (longer side+shorter side)/2.

As a result of the blast treatment prior to anodic oxidation, the length of each eutectic region 66 in the interface 27*s* is made smaller than that of the eutectic region immediately after casting. This blast treatment will be specifically described below.

Figure 7A:
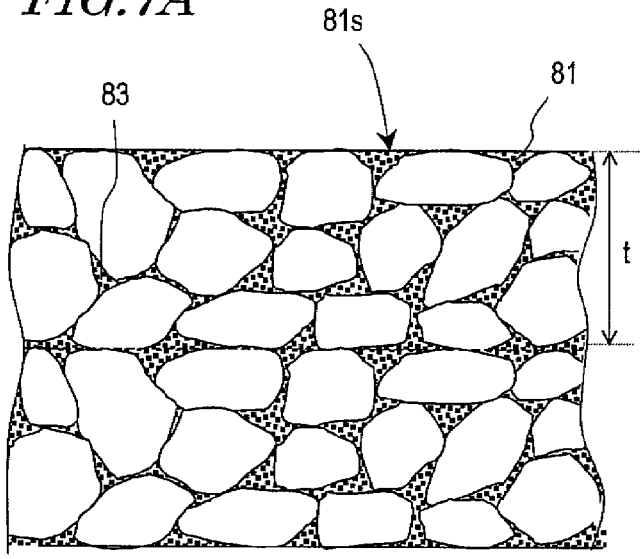
FIG. 7A is a diagram schematically showing a structural texture in a cross section of a propeller body after casting.
Figure 7B:
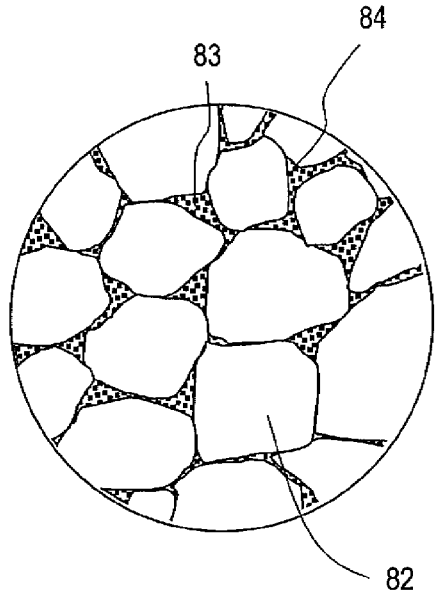
FIG. 7B is a diagram schematically showing a structural texture at a depth t from the surface.

FIGS. 7A and 7B schematically show a cross section of a propeller body 81 having been molded by casting and a structural texture thereof at a depth t from a surface 81*s*. As a result of casting, near the surface 81*s* of the propeller body 81, eutectic regions 83 have deposited among alloy phases 82. The eutectic regions 83 contain eutectic silicon particles 84. When the propeller body 81 is formed by die casting technique, each eutectic region 83 has a length of about 10 μm to about 50 μm.

Figure 8A:
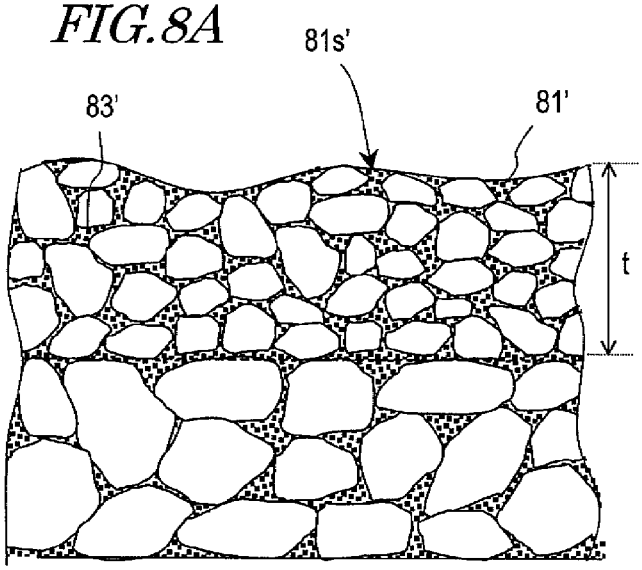
FIG. 8A is a diagram schematically showing a structural texture in a cross section of a propeller body after a blast treatment.

A shot material is shot against the surface 81*s* of the propeller body 81, thus performing a blast treatment for the propeller body 81. As the shot material collides with the surface 81*s* of the propeller body 81, a kinetic energy is applied near the surface 81*s* of the propeller body 81, whereby the eutectic regions 83 positioned near the surface 81*s* are crushed. As a result, as shown in FIG. 8A, a propeller body 81' is obtained in which finer eutectic regions 83' are distributed near a surface 81*s'*. Since the shot material abrades the surface 81*s'* of the propeller body 81', the roughness of the surface 81*s'* is increased.

Figure 8B:
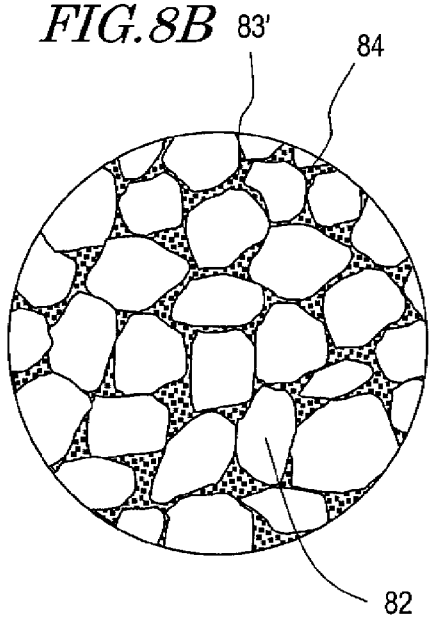
FIG. 8B is a diagram schematically showing a structural texture at a depth t from the surface.

Since the anodic oxide coating 27*c* (FIG. 5) is formed by allowing the region near the surface of the propeller body 81' to be oxidized, it is preferable that at least those eutectic regions 83' which are in a region to be converted into the anodic oxide coating 27*c* are crushed through a blast treatment so as to become smaller. As shown in FIG. 8A, if the region down to the depth t from the surface 81*s'* is to be converted into an anodic oxide coating, an interface between the anodic oxide coating and the propeller body 81' will be formed at the depth t. Therefore, as shown in FIG. 8B, it is preferable that the eutectic regions 83' down to the depth t from the surface 81*s'* are crushed so that the eutectic regions 83' each have a length in the aforementioned range at the depth t from the surface 81*s'*.

Although the eutectic regions 83' are crushed through the blast treatment, the eutectic silicon particles 84 within the eutectic regions 83' are hardly crushed.

The blast treatment is performed under conditions such that the eutectic regions 83' are crushed so as to each have a length in the aforementioned range at the depth t from the surface 81*s*'. For example, steel balls having a size of about 0.4 mm to about 1.2 mm are used as the shot material.

If an excessive blast treatment is performed, the eutectic regions lying inside the propeller body will also be crushed. From the standpoint of forming an anodic oxide coating having a uniform thickness, there is no problem in the crushing of the eutectic regions lying inside the propeller body. However, under such conditions, the surface 81*s*' will be considerably ground by the shot material, thus resulting in a large surface roughness. As a result, the roughness Rz of the propeller surface after forming the anodic oxide coating will exceed about 40 μm, which means that sufficient propulsion power will not be obtained when the propeller is attached to an outboard motor. Therefore, the blast treatment is preferably performed so that the roughness Rz of the surface 81*s*' does not exceed about 40 μm. On the other hand, the inventors have also found through detailed studies that, if the surface roughness Rz of the anodic oxide film after the blast treatment is smaller than about 25 μm, the blast treatment is not sufficient and the eutectic regions will not be small enough to obtain a uniform anodic oxide coating.

In the case where a blast treatment is performed so that the length of each eutectic region is about 18 μm or less and an anodic oxide coating is formed so that its minimum film thickness is about 20 μm or more, the difference between the maximum thickness and the minimum thickness of the anodic oxide coating will be about 25 μm or less, and thus the film thickness of the anodic oxide film is made uniform.

Figure 9:
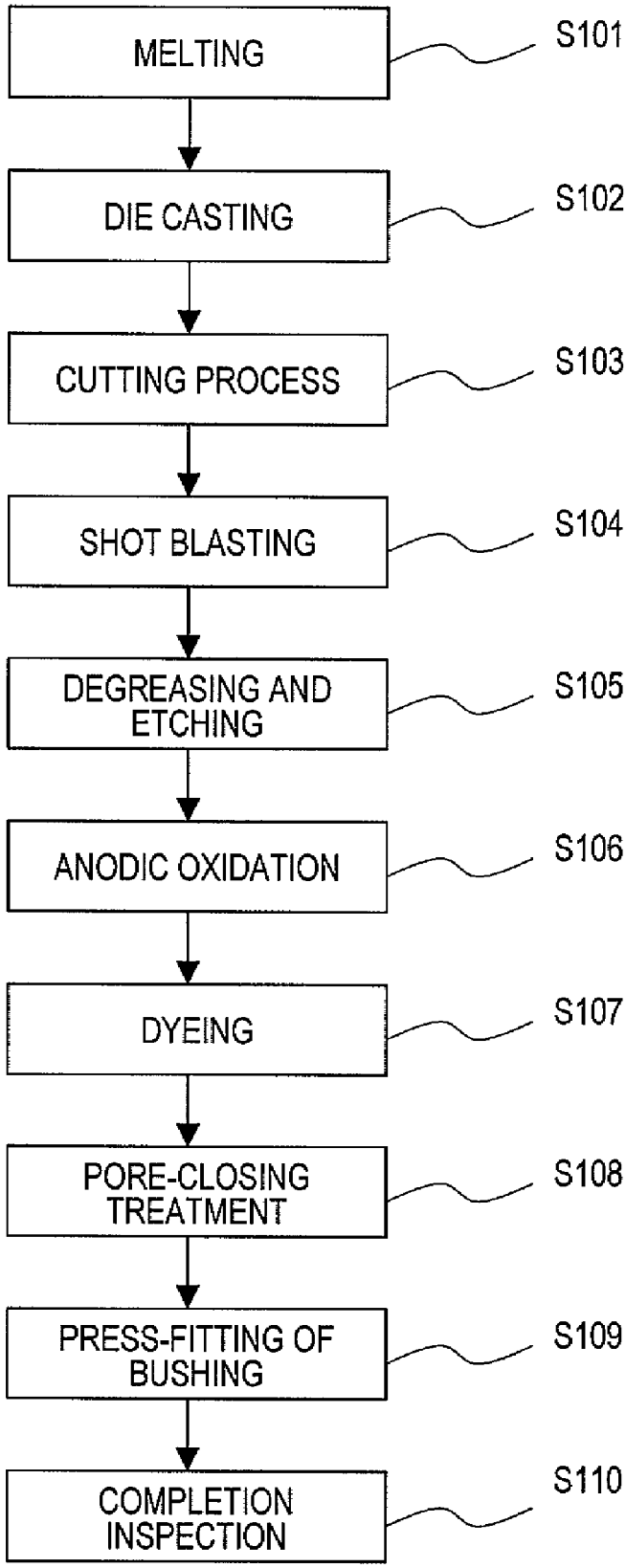
FIG. 9 is a flowchart showing production steps for the propeller shown in FIG. 3.

A propeller according to a preferred embodiment of the present invention can be produced by the following procedure, for example. As shown in FIG. 9, an aluminum alloy having a composition of Al-4Mg-0.8Fe-0.4Mn, for example, is melted (step S101), and the melt is injected into a mold of the shape shown in FIG. 3 according to die casting technique (step S102). After cooling, the gate for melt injection is cut off from the propeller body which has been taken out of the mold, and a cutting process is performed (e.g., adjustment of thickness and shape of the blades) so that the propeller body will take a predetermined shape (step S103).

Next, the propeller body is subjected to a blast treatment as described above (step S104). Before or after the blast treatment, foreign objects and the like on the surface of the propeller body may be removed through a mechanical, chemical or electrical treatment. Then, after cleaning the propeller surface by degreasing and etching the propeller body surface (step S105), an anodic oxidation is performed (step S106). For example, by using a 17% sulfuric acid bath and using the propeller body as an anode, an oxidation is performed for 30 minutes with a constant current of 4 A/dm2, while maintaining a bath temperature of 4° C. As a result, an anodic oxide coating having a thickness of 40 μm and a hardness of 400 Hv is obtained.

Next, dyeing may be performed as necessary (step S107). The dyeing can be performed through coloration by dyestuff, electric field coloration, or the like, which takes place by allowing a dyestuff or metal oxide to deposit within the micropores in the anodic oxide coating. Thereafter, a pore-closing treatment is performed for the micropores in order to prevent decolorization and insufficiencies in anticorrosiveness (step S108).

Thereafter, a bushing is press-fitted into the hub of the propeller (S109), and a completion inspection (S110) is performed, whereby propeller is completed.

Since the surface of the propeller 27 having the above structure is covered with an anodic oxide coating having a high hardness, the propeller 27 has excellent abrasion resistance. Moreover, the anodic oxide coating is obtained by performing a blast treatment for the surface of the propeller body that has been molded by casting, and thereafter subjecting the surface to anodic oxidation. Thus, the blast treatment provides an improvement on the non-uniformnesses in composition near the surface of the propeller body (e.g., eutectics and the like that have deposited through the casting), whereby an anodic oxide coating having a uniform film thickness is obtained. Therefore, problems such as corrosion due to progress of partial abrasion are unlikely to occur, and thus the propeller can enjoy a long product life. In particular, abrasion of the propeller surface can be prevented even in water which is mixed with sand or the like. Thus, there also are economical advantages. Furthermore, in terms of the exterior appearance of the propeller, color mottling or the like is unlikely to occur because the anodic oxide coating has a uniform thickness. Thus, a propeller which is also aesthetically excellent is obtained.

Therefore, in accordance with a boat having the outboard motor according to a preferred embodiment of the present invention, abrasion of the propeller is prevented even when traveling over a sandy shallow. Therefore, when used at inshore locations and on rivers, for purposes such as fishery, business operations, and leisure activities, a boat having the outboard motor according to a preferred embodiment of the present invention will exhibit excellent durability, thus being economical.

EXPERIMENTAL EXAMPLES

Experiment 1

In order to confirm the effects according to preferred embodiments of the present invention, propeller bodies were molded by either one of two casting methods, and blast treatments under various conditions were performed for their respective surfaces, followed by formation of an anodic oxide coating, thus producing samples. The physical properties and the like of the samples were examined. For comparison, samples which were not subjected to a blast treatment were also produced, and their characteristics were subjected to comparison. The results are shown in Table 1 below.

Propeller bodies of Samples 1 to 5 were produced by die casting technique, using an aluminum alloy having a composition of Al-4Mg-0.8Fe-0.4Mn-0.3Si. Propeller bodies of Samples 6 to 8 were produced by gravity casting technique, using an aluminum alloy having a composition of Al-7Si-0.4Fe-0.3Mg.

Propeller bodies of Samples 2 to 5, 7, and 8 were subjected to blast treatments under different conditions. For comparison, no blast treatment was performed for the propeller bodies of Samples 1 and 6.

The characteristics of the produced samples were evaluated as follows.

Eutectic Silicon Particle Size and Size of Eutectic Region

The eutectic silicon particle size and size of eutectic region at the interface of the propeller body between itself and the anodic oxide coating were determined via SEM observation.

Surface Roughness

By a method defined under JIS B0601, the roughness Rz (ten point-average roughness) of the surface of the anodic oxide coating was measured by using a surface roughness measuring apparatus.

Film Thickness

A cross section of the anodic oxide coating was observed with a metallurgical microscope to determine a film thickness of the anodic coating.

Exterior Appearance

At a position of about 300 mm away from the sample surface, acceptability of the exterior appearance was determined by visual inspection under diffused daylight. Symbols "○" and "x" represent, respectively, "uniform" and "non-uniform" exterior appearances.

Abrasion Resistance Characteristics

A sand-dropping abrasion test as defined under JIS H8501 was performed for a certain period of time, and acceptability was determined based on exterior appearance. "○" indicates that the propeller body (base) is not exposed; and "x" indicates that the propeller body is exposed.

Performance Test

Each Sample was attached to an outboard motor having a predetermined output power, and a certain distance was traveled by driving the engine at predetermined revolutions; and the time spent was measured. Also, a similar method was conducted by using a conventional propeller having a paint coating, and the time spent was measured. "○" indicates that a similar result to the conventional propeller was obtained with respect to the time spent, whereas "x" indicates that a considerably longer time was spent than the time spent by the conventional propeller.

Determination

With respect to evaluations of abrasion resistance characteristics and the performance tests, any sample that has one more evaluation items being rated as "x" is determined as "x".

The surface roughness of the anodic oxide coating increases as the blast treatment time becomes longer. The difference δ between the maximum film thickness and the minimum film thickness of the anodic oxide coating becomes generally smaller as the eutectic regions become smaller. This indicates that the uniformity of the film thickness of an anodic oxide coating can be improved by reducing the size of eutectic regions through a blast treatment. However, a comparison between Samples 4-5 and Samples 7-8 indicates that Samples 7 and 8 have smaller eutectic regions, but have a greater difference δ between the maximum film thickness and the minimum film thickness than in Samples 4 and 5. The presumable reason for this is that, since the eutectic silicon particles of Samples 7 and 8 have a greater particle size, Samples 7 and 8 contain more silicon within the eutectic regions, thus making it difficult to form an anodic oxide coating.

Among the Samples obtained, Samples 1 and 6 have a non-uniform exterior appearance. This is presumably an influence of the non-uniform film thickness of the anodic oxide coating, which in turn is ascribable to the large eutectic regions.

As for abrasion resistance characteristics, Samples 4, 5, 7, and 8, in which the anodic oxide coating has a minimum film thickness of about 20 μm or more, show good results. Even in Samples 1 and 2, the abrasion resistance characteristics ratings might be improved by prolonging the anodic oxidation treatment time and forming the anodic oxide coating so as to have a minimum film thickness or about 20 μm or more. However, since the film thickness is not uniform, an anodic oxidation will presumably need to be performed for a very long-time to ensure that there is a minimum film thickness of about 20 μm or more.

As for the performance tests, Samples 7 and 8 have poor ratings. The presumable reason is that, since the propeller surface has a roughness of more than about 40 μm, sufficient propulsion power is not obtained. In particular, Sample 8 has been ground by the blast treatment to such an extent that the propeller is deformed and does not have a predetermined thickness.

TABLE 1

| Sample No. | blast treatment size (mm) | blast treatment time (sec.) | Si particle size (μm) | S Size of eutectic region (μm) | surface roughness Rz (μm) | film thickness (μm) minimum | film thickness (μm) maximum | δ | anodic oxidation treatment time (min.) | exterior appearance | abrasion resistance characteristics | performance test | determination |
|---|---|---|---|---|---|---|---|---|---|---|---|---|---|
| 1 | — | 0 | 0.8 | 42 | 13 | 5 | 49 | 44 | 60 | X | X | ○ | X |
| 2 | 0.4 | 40 | 0.8 | 28 | 31 | 10 | 48 | 38 | 60 | ○ | X | ○ | X |
| 3 | 0.4 | 80 | 0.8 | 23 | 33 | 18 | 47 | 29 | 60 | ○ | X | ○ | X |
| 4 | 0.4 | 120 | 0.8 | 17 | 37 | 22 | 47 | 25 | 60 | ○ | ○ | ○ | ○ |
| 5 | 0.4 | 200 | 0.8 | 18 | 40 | 21 | 45 | 24 | 60 | ○ | ○ | ○ | ○ |
| 6 | — | 0 | 1.3 | 35 | 30 | 10 | 65 | 55 | 90 | X | X | ○ | X |
| 7 | 1.0 | 180 | 1.3 | 15 | 60 | 25 | 53 | 28 | 90 | ○ | ○ | X | X |
| 8 | 1.0 | 240 | 2.0 | 16 | 71 | 26 | 55 | 29 | 120 | ○ | ○ | * | X |

* bad shape

As can be seen from Table 1, a blast treatment decreases the size of eutectic regions. Moreover, as the blast treatment time becomes longer, the eutectic regions generally become smaller. However, between Samples 4 and 5, the sizes of eutectic regions are almost the same, in spite of the different blast treatment times. Therefore, it is presumable that the effect of crushing the eutectic regions through a blast treatment is saturated at about 120 seconds. Similar results are also obtained between Samples 7 and 8.

On the other hand, the size of eutectic silicon particles is not changed by the blast treatment. Thus, it is presumable that the eutectic silicon particles are not crushed through a blast treatment.

From these results, it can be seen that, in order to realize a uniform film thickness of the anodic oxide film, it is effective to make the eutectic regions small by a blast treatment. In particular, Samples 4 and 5, in which the eutectic regions each have a length of about 18 μm or less and the eutectic silicon particles have a particle size of about 0.8 μm or less, have an excellent abrasion resistance and are suitable as durable propellers for watercraft.

Experiment 2

The propeller of Sample 5 was attached to an outboard motor (F40BWHDL-0000008; YAMAHA HATSUDOKI KABUSHIKI KAISHA), which in itself was mounted on a boat (W-23AF1; YAMAHA HATSUDOKI KABUSHIKI KAISHA). The throttle was operated so that the engine revolutions would be constant at 1000, 2000, 3000, 4000, or 5000 RPM, and the boat velocity at each revolutions value was measured. These measurements were repeated several times and an average achievable velocity at each revolution value was calculated. For comparison, a Conventional Sample having no anodic oxide coating was produced by forming a painted protective film on a propeller body which had been subjected to a blast treatment under the conditions of Sample 2, and similar measurements were taken. Note that the Conventional Sample had a surface roughness of Rz=1.5 μm.

Moreover, these two Samples were each attached to an outboard motor which was mounted on a boat, and a user test was conducted where the boat was used for 160 days in an environment where a sand beach was utilized as a point of mooring. The aforementioned measurements were taken with respect to each Sample after the user test.

TABLE 2

| | average achievable velocity | | | |
|---|---|---|---|---|
| | immediately after Sample is produced | | after user test | |
| engine revolutions (RPM) | Sample 5 (Km/h) | Conventional Sample (Km/h) | Sample 5 (Km/h) | Conventional Sample (Km/h) |
| 1000 | 6 | 6 | 6 | 6 |
| 2000 | 12 | 12 | 12 | 11 |
| 3000 | 21 | 20 | 21 | 17 |
| 4000 | 32 | 31 | 32 | 26 |
| 5000 | 42 | 42 | 42 | 37 |

As is clear from Table 2, the propeller of Sample 5 has a propulsion power which is quite similar to that of the conventional product, although having a surface roughness Rz of about 40 μm. It can also be seen that, even after the user test, Sample 5 provides a propulsion power similar to that which was available immediately after the production, which indicates the fact that the propeller is hardly abraded. On the other hand, the achievable velocity is decreased in the conventional product. In particular, the achievable velocity is decreased by about 10% to about 20% during high revolutions (4000 RPM or 5000 RPM), indicative of a decrease in propulsion power due to abrasion of the propeller.

Figure 10:
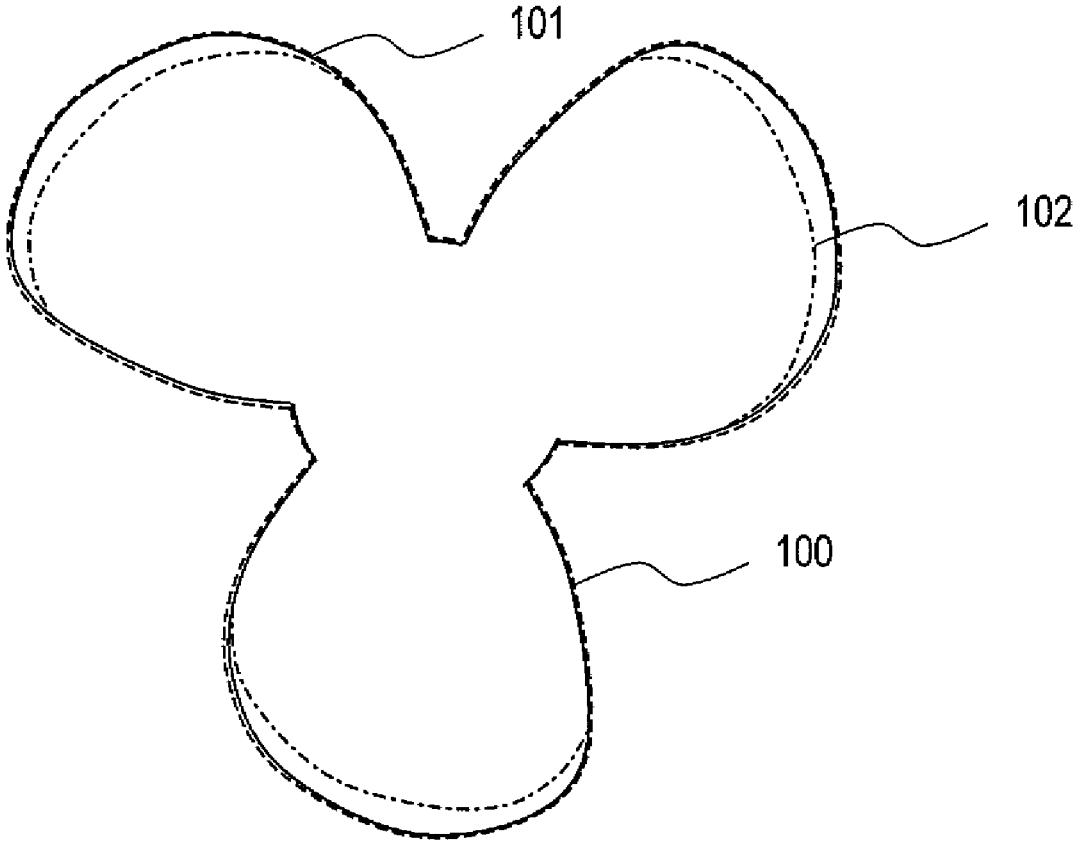
FIG. 10 shows projections of a propeller according to an Example and a conventional propeller after a user test.

FIG. 10 shows shapes that are obtained by projecting, onto a plane which is perpendicular to the axis, the propellers of Sample 5 and Conventional Sample after experiencing the user test. In FIG. 10, a solid line shows a projected shape 100 of each Sample immediately after production. After the user test, Sample 5 retains a projected shape 101 which is almost identical to the projected shape 100 immediately after the Sample was produced. On the other hand, a projected shape 102 of the Conventional Sample after the user test is smaller than the projected shape 100. Specifically, the blades have been ground near the ends to become smaller. Such abrasion at the blade ends is presumably caused by sand and the like. When the blade area is reduced in this manner, the amount of water which is ejected toward the rear by the propeller rotation is reduced, whereby the propulsion power is decreased. This would result in poorer mileage.

From these results, it can be seen that the propeller according to preferred embodiments of the present invention can prevent a decrease in propulsion power due to abrasion, and is economically advantageous.

The propeller for watercraft and outboard motor according to preferred embodiments of the present invention is suitably used for various kinds of boats, and is particularly suitably used for small-sized boats intended for various purposes, e.g., fishery, business operations, or leisure activities.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Applications No. 2006-229906 filed on Aug. 25, 2006 and No. 2007-210916 filed Aug. 13, 2007, the entire contents of which are hereby incorporated by reference.

What is claimed is:

1. A propeller for watercraft, comprising:

a propeller body having a blade and a hub portion, the propeller body being made of a molded cast aluminum alloy; and an anodic oxide coating arranged so as to cover a surface of the propeller body;

wherein the surface of the propeller body is a blast-treated surface and the anodic oxide coating is made an anodic oxidized material.

2. The propeller for watercraft of claim 1, wherein the aluminum alloy contains silicon, and at an interface of the propeller body between itself and the anodic oxide coating, eutectic regions containing eutectic silicon particles each have a length of about 18 μm or less.

3. The propeller for watercraft of claim 2, wherein the anodic oxide coating has a surface roughness Rz of no less than about 25 μm and no more than about 40 μm.

4. The propeller for watercraft of claim 3, wherein the anodic oxide coating has a thickness of no less than about 20 μm and no more than about 100 μm.

5. The propeller for watercraft of claim 4, wherein the anodic oxide coating has a hardness of no less than about 350 Hv and no more than about 450 Hv.

6. The propeller for watercraft of claim 1, wherein the propeller body is made of a molded die cast aluminum alloy.

7. The propeller for watercraft of claim 2, wherein the eutectic silicon particles in the eutectic regions each have a particle size of about 0.8 μm or less at the interface.

8. The propeller for watercraft of claim 1, wherein the aluminum alloy is an Al—Mg alloy containing no less than about 0.3 wt % and no more than about 2.0 wt % of silicon.

9. An outboard motor comprising the propeller for watercraft of claim 1.

10. A boat comprising the propeller for watercraft of claim 1.

11. A propeller for watercraft, comprising:

a propeller body made of a die-cast aluminum alloy which contains silicon in an amount of less than about 0.3 wt % and no more than about 2.0 wt %; and an anodic oxide coating provided on a surface of the propeller body; wherein a minimum thickness of the anodic oxide coating is no less than about 20 μm and a maximum thickness of the anodic oxide coating is no more than about 100 μm, and a difference between the maximum thickness and the minimum thickness is about 25 μm or less.

12. The propeller for watercraft of claim 11, wherein the anodic oxide coating has a hardness of no less than about 350 Hv and no more than about 450 Hv.

* * * * *